US008070506B2

(12) United States Patent
De Dios Martin et al.

(10) Patent No.: US 8,070,506 B2
(45) Date of Patent: Dec. 6, 2011

(54) CONNECTOR FOR USE IN TERMINATING COMMUNICATIONS CABLES

(75) Inventors: Longinos De Dios Martin, Barcelona (ES); Maria Maqueda Gonzalez, Barcelona (ES); Francisco Carlos Chamorro Davalos, Sevilla (ES)

(73) Assignee: Tyco Electronics AMP Espana SA, Barcelona (ES)

( * ) Notice: Subject to any disclaimer, the term of this patent is extended or adjusted under 35 U.S.C. 154(b) by 81 days.

(21) Appl. No.: 12/518,931

(22) PCT Filed: Dec. 5, 2007

(86) PCT No.: PCT/GB2007/004658

§ 371 (c)(1), (2), (4) Date: Jun. 12, 2009

(87) PCT Pub. No.: WO2008/071917

PCT Pub. Date: Jun. 19, 2008

(65) Prior Publication Data

US 2010/0015844 A1 Jan. 21, 2010

(30) Foreign Application Priority Data

Dec. 15, 2006 (GB) ..... 0625061.7

(51) Int. Cl.
*H01R 4/24* (2006.01)

(52) U.S. Cl. ..... 439/409

(58) Field of Classification Search ..... 439/409, 439/410, 607.47, 607.53
See application file for complete search history.

(56) References Cited

U.S. PATENT DOCUMENTS

| | | | | | |
|---|---|---|---|---|---|
| 4,037,906 | A | * | 7/1977 | Jayne | 439/396 |
| 4,094,566 | A | | 6/1978 | Dola et al. | |
| 4,181,384 | A | * | 1/1980 | Dola et al. | 439/497 |
| 4,367,909 | A | * | 1/1983 | Shatto et al. | 439/497 |
| 4,449,778 | A | * | 5/1984 | Lane | 439/607.47 |
| 4,824,383 | A | * | 4/1989 | Lemke | 439/108 |
| 4,878,853 | A | * | 11/1989 | Yamade et al. | 439/144 |
| 5,030,133 | A | * | 7/1991 | Rudoy | 439/409 |
| 5,947,761 | A | * | 9/1999 | Pepe | 439/409 |
| 6,224,423 | B1 | | 5/2001 | Yip et al. | |
| 6,238,235 | B1 | * | 5/2001 | Shavit et al. | 439/418 |
| 6,328,601 | B1 | * | 12/2001 | Yip et al. | 439/607.8 |
| 6,682,363 | B1 | * | 1/2004 | Chang | 439/409 |
| 7,021,967 | B2 | * | 4/2006 | Mullin | 439/607.41 |

FOREIGN PATENT DOCUMENTS

| | | |
|---|---|---|
| DE | 100 65 136 A1 | 7/2002 |
| EP | 1 310 019 B1 | 11/2006 |

OTHER PUBLICATIONS

International Search Report for PCT/GB2007/004658 issued by the European Patent Office on May 9, 2008.

* cited by examiner

*Primary Examiner* — Neil Abrams
(74) *Attorney, Agent, or Firm* — Baker & Daniels LLP

(57) ABSTRACT

A connector for use in terminating communications cables including electrical contacts (42) arranged to receive wires (30) of a communications cable (60), at least one cover (12, 22) pivotally connected with the connector and having wire-receiving spaces (14, 24), wherein the cover is arranged to move pivotally to bring wires positioned in its wire-receiving spaces into engagement with the contacts (42).

28 Claims, 16 Drawing Sheets

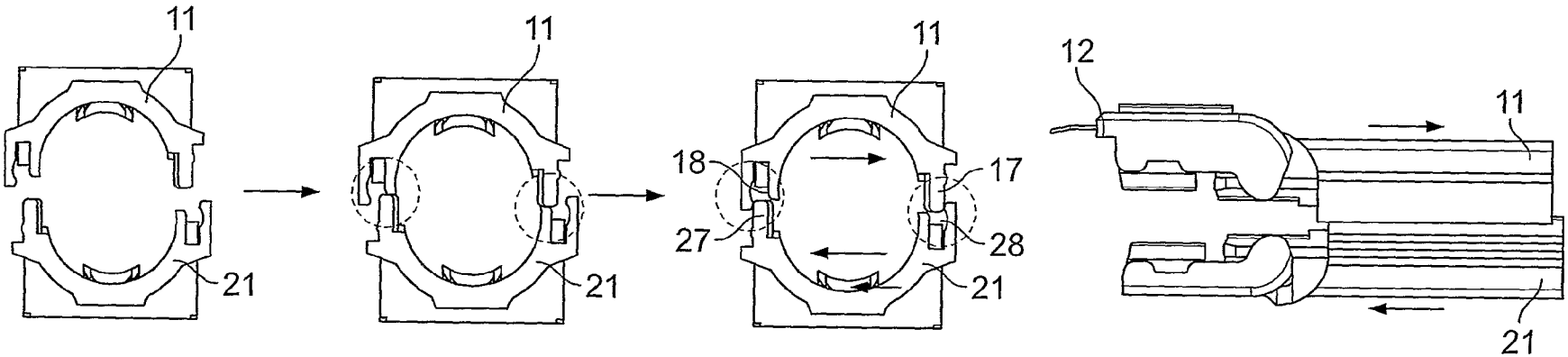
FIG. 3A
FIG. 3B
FIG. 3C
FIG. 3D
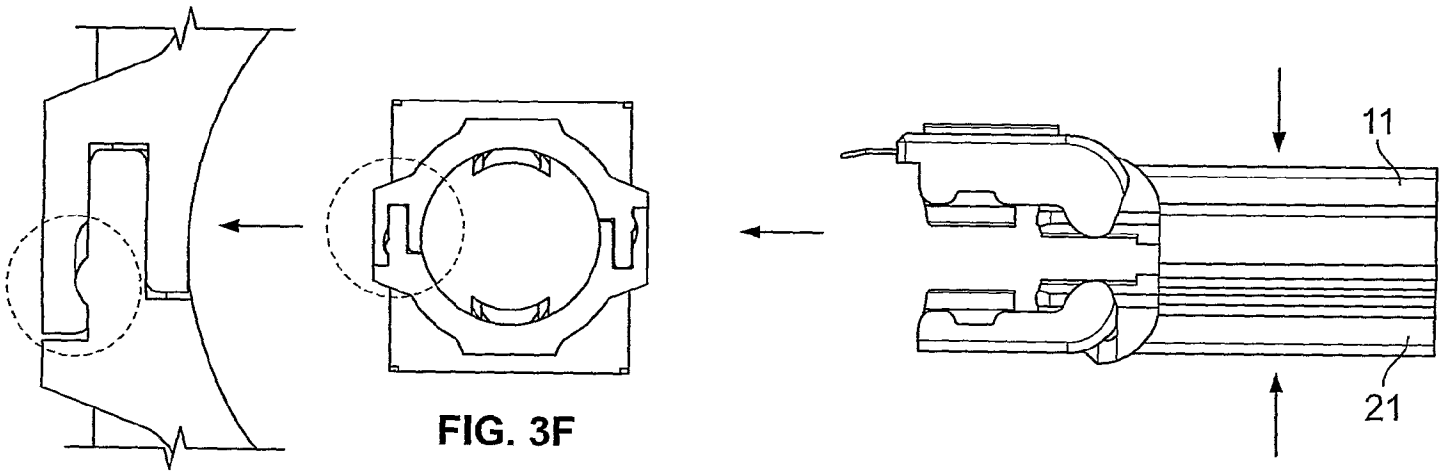
FIG. 3E
FIG. 3F
FIG. 3G

CONNECTOR FOR USE IN TERMINATING COMMUNICATIONS CABLES

CROSS-REFERENCE TO RELATED APPLICATION

This application is a National Stage filing of PCT International Application Serial No. PCT/GB2007/004658, filed Dec. 5, 2007, which claims the benefit of GB Application Serial No. 0625061.7, filed Dec. 15, 2006, the disclosures each of which are expressly incorporated herein by reference.

TECHNICAL FIELD

This invention relates to a connector for use in terminating communications cables.

SUMMARY OF THE INVENTION

In a first aspect the present invention provides a connector for use in terminating communications cables including: electrical contacts arranged to receive wires of a communications cable; at least one cover pivotally associated with the connector; wire receiving spaces for guiding the wires are associated with the at least one cover; and the at least one cover is arranged to move pivotally to bring the wires into engagement with the electrical contacts.

The electrical contacts will preferably be insulation-displacing or -piercing contacts, but other kinds of contacts may be used, for example when stripped wire ends are provided for connection to the contacts. The electrical contacts may be provided on a removable contact carrier, for example on opposed faces of the carrier, and the carrier may be retained in the connector by the at least one cover. The carrier may at least partly shield the inside of the connector from external electromagnetic radiation, and may at least partly prevent emission of electromagnetic radiation from the interior of the plug to the outside. Preferably the carrier will include cross-shaped or other internal shielding to prevent or reduce cross-talk radiation between respective wire pairs within the plug. The carrier may include at least one recess that aligns with the at least one cover to position the carrier in the connector. The recess may receive a cam portion of the at least one cover to position the carrier.

The at least one cover may be pivotally moveable from a first position to a second position, the cable terminated by the connector has a longitudinal axis and in the first position the wire receiving spaces extend away from the longitudinal axis of the cable and in moving to the second position the wire receiving spaces are brought closer to aligning with the axis. The at least one cover may at least partly shield the inside of the connector from external electromagnetic radiation and may at least partly prevent or reduce emission of its internal electromagnetic radiation to the outside. The connector may be in the form of a plug or a jack, and may include two covers, which may be provided on opposite sides of the connector.

The connector may include two (or more) shells which fit about the cable, the shells preferably including resilient flanges, which flanges press against the cable to grip the cable, and which flanges may establish electrical contact with foil, braid, or other electromagnetic shielding carried by the cable. The resilient flanges may be provided on a removable insert of the shell. The shells may be a snap-fit together, the snap-fit preferably being achieved by way of a lug which runs run for substantially the entire length of at least one of the shells.

In preferred embodiments of the invention, at least one, more preferably all, of the resilient flanges is/are provided with teeth having sharp points that pass through the folded-back braid or foil shield of the cable and sink into the cable jacket, to both retain the connector on the cable and make electrical continuity between the cable shield and the connector. Designs having all of the flanges toothed to provide cable retention and electrical continuity are superior to designs in which one flange provides electrical continuity, and the rest of the flanges are untoothed continuous ridges that must grip the cable beyond the folded-back braid/foil shield in order to resist sliding along the cable jacket. The more preferred toothed flange design thus achieves better cable retention and simplifies installation since the length of the braid/foil shield that is folded back over the cable jacket is not critical, whereas for untoothed flange designs the folded-back shield length must be adjusted to be engaged by only the first electrical-continuity flange but not by the other cable-gripping flanges.

A second aspect the present invention accordingly provides a cable clamp for a connector, the cable clamp including the aforementioned two or more shells which fit about a cable, wherein the shells further include resilient flanges which press against the cable to grip the cable and which may establish electrical contact with the usual shielding braid or foil of the cable. The resilient flanges may be provided on a removable insert of the shell. The cable clamp preferably includes two shells which snap-fit together fit about the cable. The snap-fit may be achieved by way of a lug which runs for substantially the entire length of at least one of the shells.

In a third aspect the present invention provides a contact carrier for use with a connector including: electrical contacts for interengagement with wires of a communications cable are provided on a body portion of the carrier; the carrier includes at least one recess that may be engaged with the connector to retain the carrier in the connector when the carrier is correctly inserted in the connector. The carrier may at least partly shield the inside of the connector from external electromagnetic radiation, and may at least partly prevent emission of electromagnetic radiation from the interior of the plug to the outside. Preferably the carrier will include cross-shaped or other internal shielding to prevent or reduce cross-talk radiation between respective wire pairs within the plug. The electrical contacts may be provided on opposed faces of the carrier.

The carrier and the cover or covers of the connector are preferably provided with snap-engageable formations, for example groove and recess formations, to retain the cover(s) in closed position about the carrier.

BRIEF DESCRIPTION OF THE DRAWINGS

An embodiment of the present invention will now be described, by way of example only, with reference to the accompanying drawings, in which:

FIGS. 3A to 3G illustrate the snap-fitting together of the first and second sub-assemblies;

DETAILED DESCRIPTION OF THE PREFERRED EMBODIMENT

Figure 1:
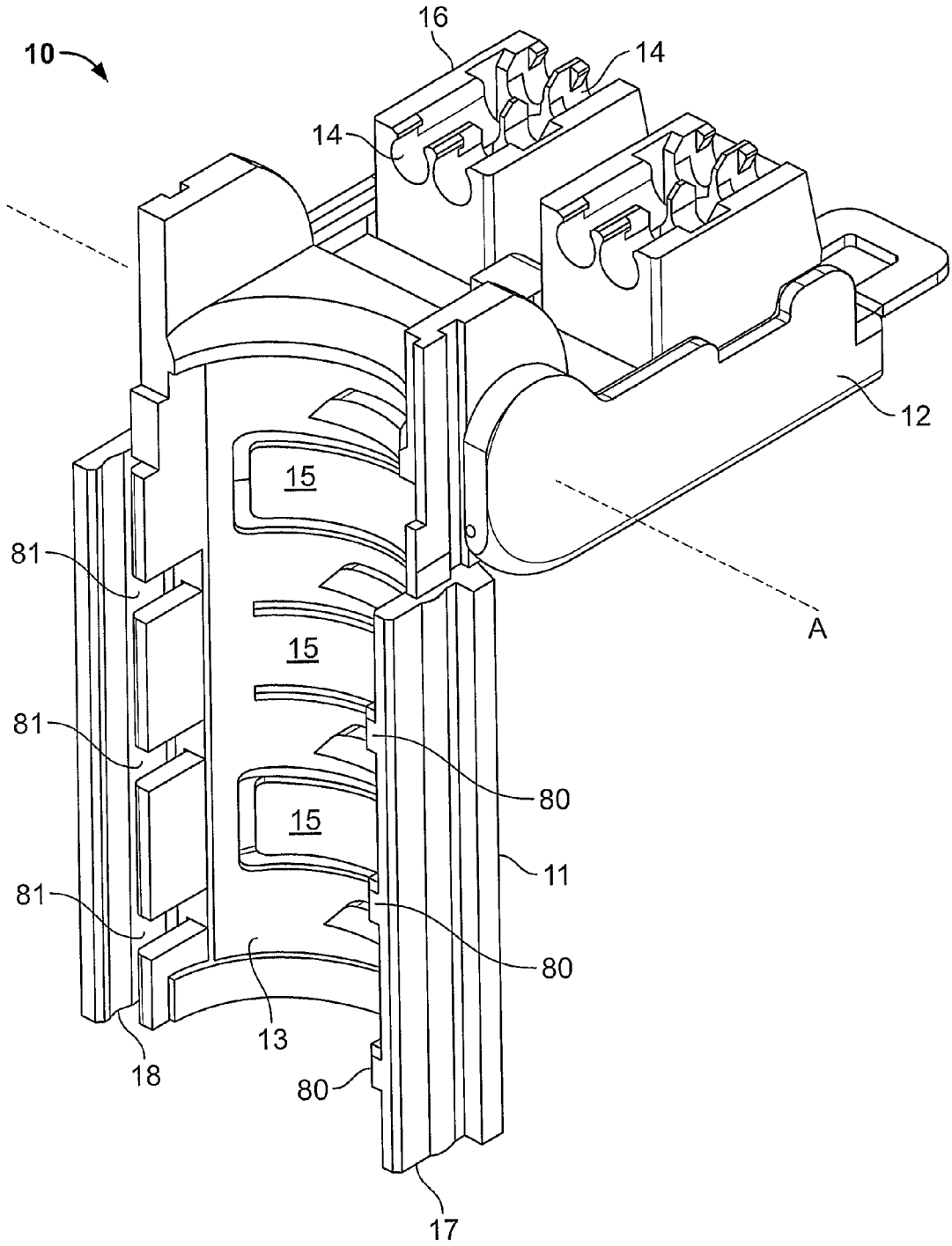
FIG. 1 is a perspective view of a first sub-assembly which forms part of an embodiment of a connector according to the present invention.
Figure 2:
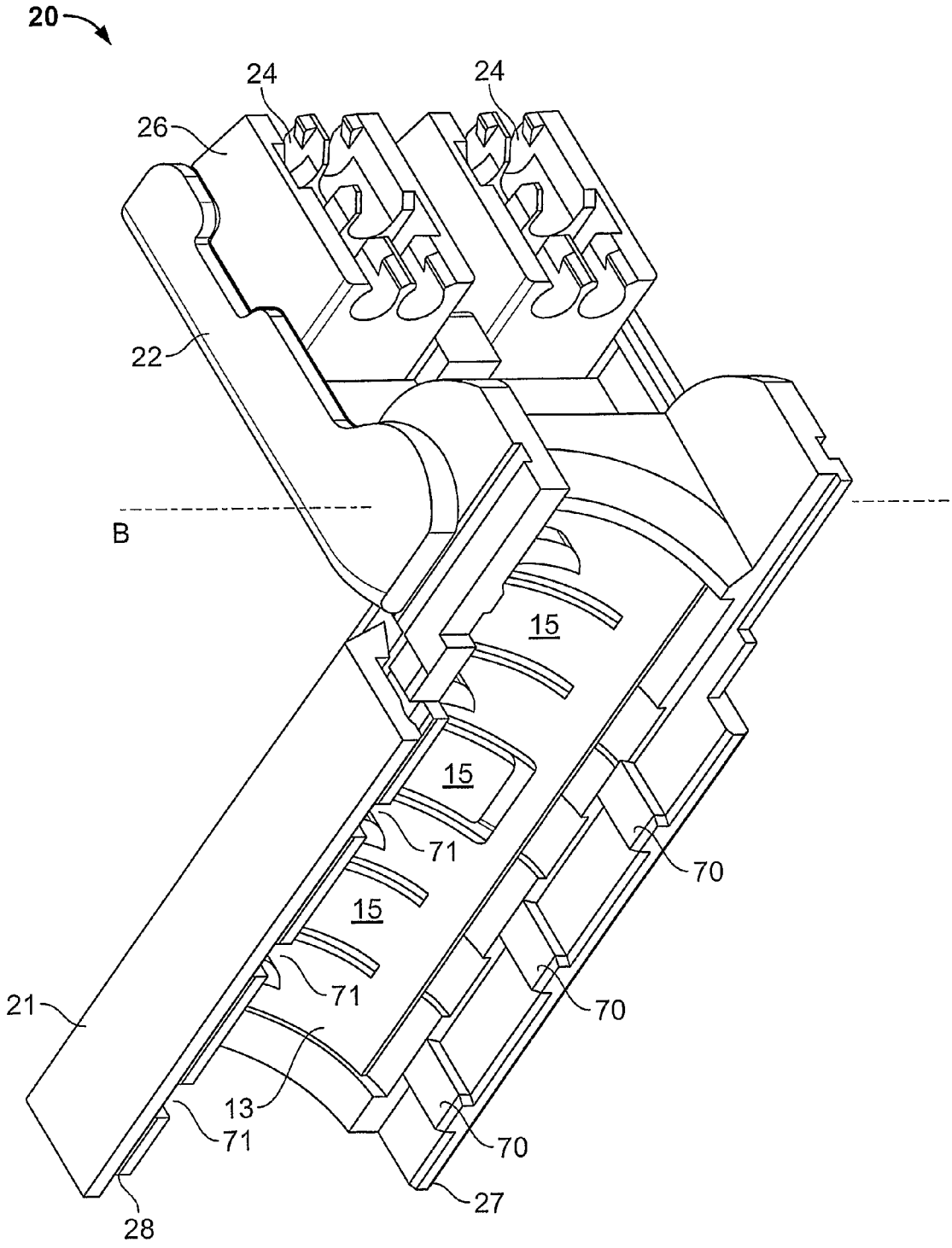
FIG. 2 shows a second sub-assembly for use with the sub-assembly of FIG. 1.

Referring to FIG. 1 a first sub-assembly 10 of a connector is shown which includes a shell in the form of casing 11 and an electrically-conductive cover 12, both of which are formed from a metallic alloy known in this field of technology as "Zamak". Cover 12 is pivotally connected to casing 11 and may pivot about axis A. Wire-receiving spaces 14 are provided in a plastic lacing fixture 16 which is affixed to the inside of cover 12. Referring to FIG. 2, a second sub-assembly 20 is shown which is complementary to the first sub-assembly and is similar in construction. Cover 22 and casing 21 are formed from Zamak and are pivotally connected about axis B. Wire-receiving spaces 24 are provided in lacing fixture 26. Casing 21 is identical to casing 11.

The casings 11 and 21 both include removable inserts 13 which include resilient flanges 15. The casings 11 and 21 are arranged to be snap-fitted together about a cable to be terminated to form a cable clamp around the cable. A foil-shielded cable is typically used. A length of outer insulation is removed from the end of the cable to be terminated and a section of the exposed foil shield is folded back over the cable outer insulation. The resilient flanges 15 become compressed about the cable when casings 11, 21 are snap-fitted together to grip the cable and provide strain relief. Inserts 13 are made of electrically conductive material and press against the folded back section of foil to achieve electrical continuity between the foil shield in the cable and the connector. Casing 11 includes a lug 17 and a recess 18. Casing 21 includes complementary recess 28 and lug 27. To snap-fit the casings together lug 17 is snap-fitted into recess 28 and lug 27 is snap-fitted into recess 18.

Referring to FIGS. 3A to 3G, the operation of snap-fitting together the two casings is illustrated. In these figure the cable is not shown for simplicity. At FIG. 3A, casings 11, 21 are brought together until they touch (see FIG. 3B). Casings are then manipulated so that lugs 17, 27 align with recesses 18, 28 (see FIG. 3C). At FIG. 3D, casings are aligned so that recesses 81, 71 line up with lugs 80, 70 which are visible in FIGS. 1 and 2. Casings 11, 21 are then pressed together to arrive at the arrangement shown in FIGS. 3E and 3F. Casings 11, 21 are snap-fitted together by way of the lug and groove formation shown in FIG. 3G.

Figure 4:
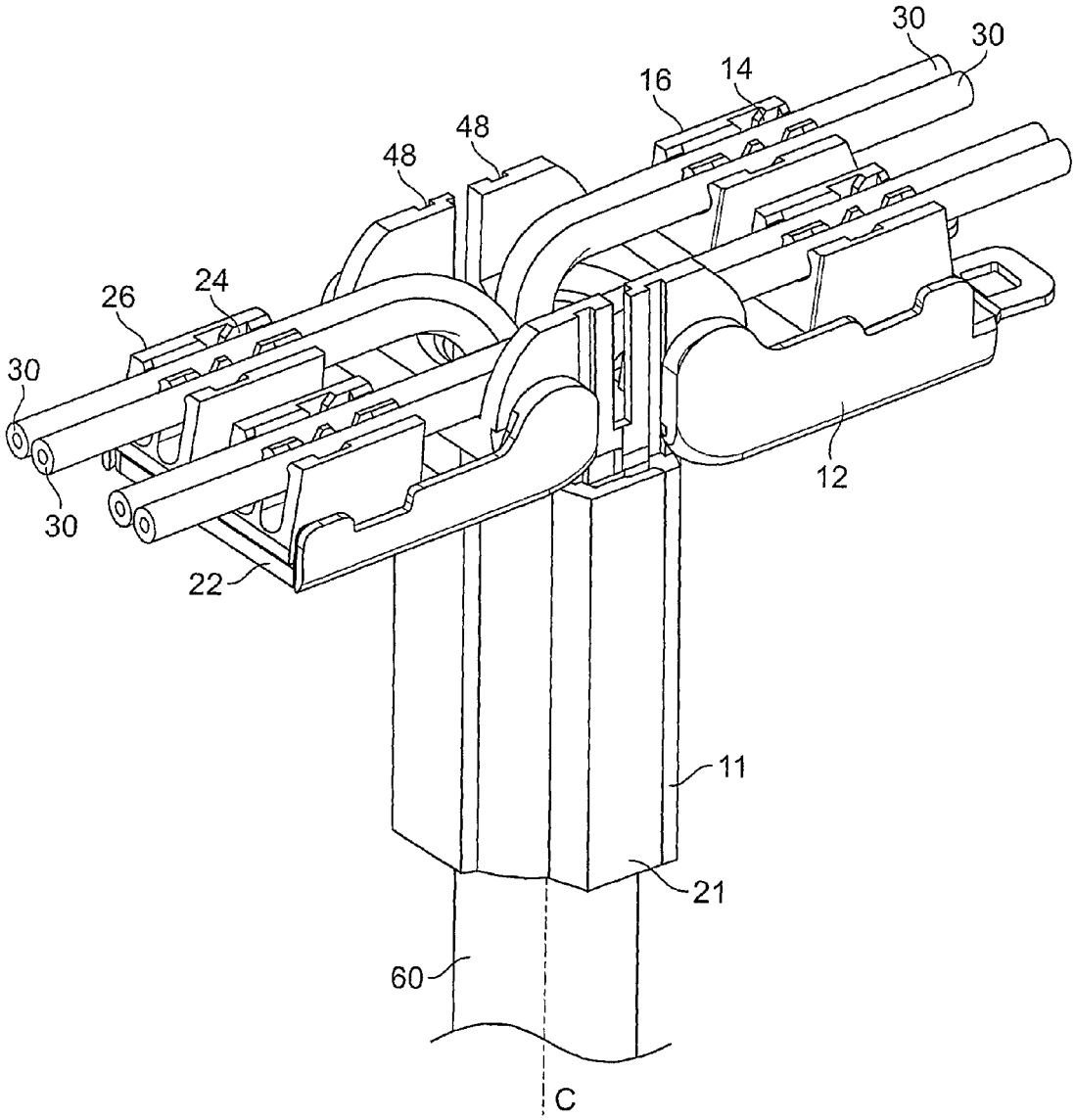
FIG. 4 shows the first and second sub assemblies assembled together with a cable to be terminated.
Figure 4A:
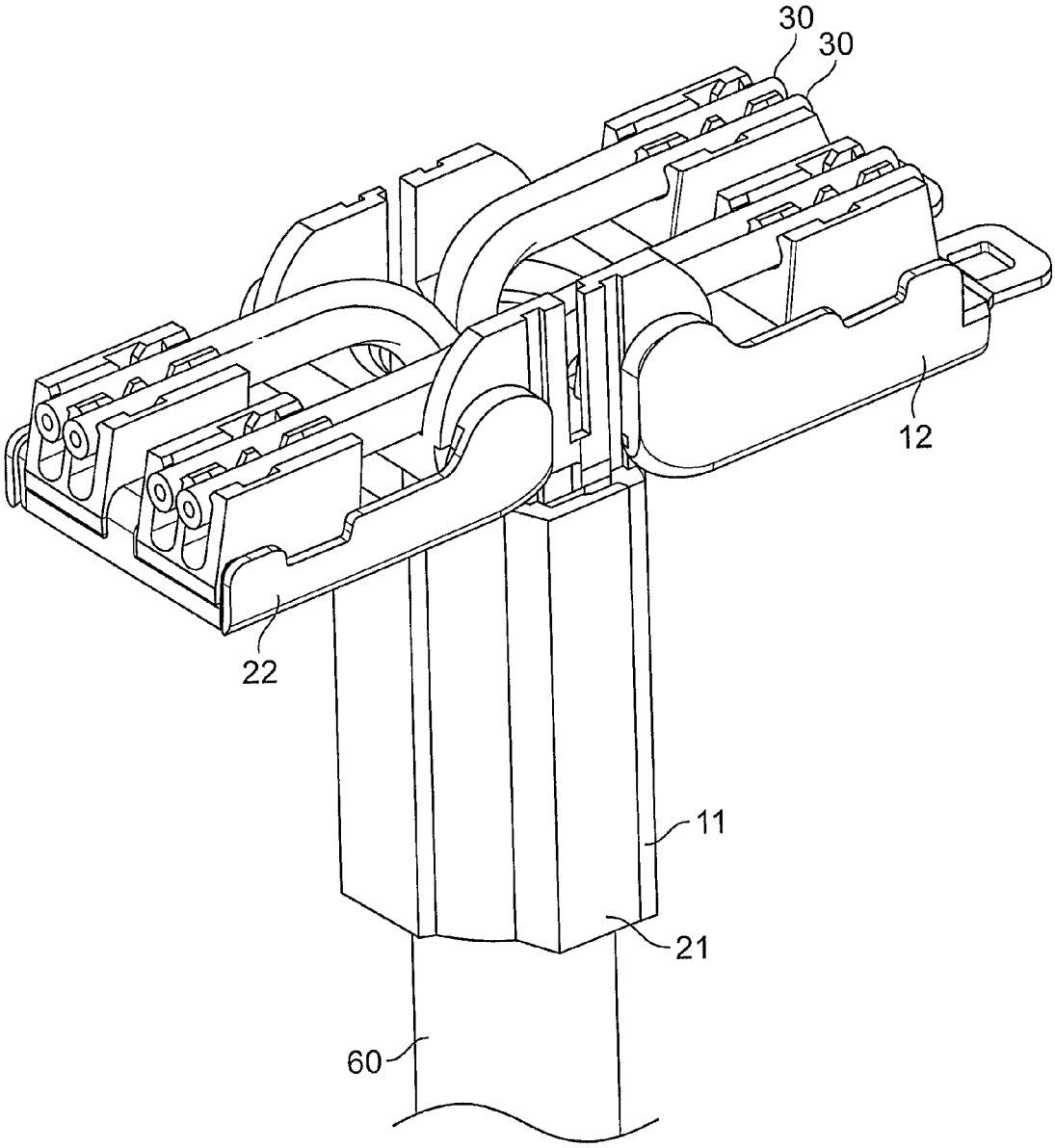
FIG. 4A shows the assembly of FIG. 3 with wire ends trimmed.

Termination of a cable by way of the connector will now be described. Referring to FIG. 4, sub-assemblies 10, 20 are shown having been snap-fitted together about a cable 60 and wires 30 of cable 60 have been positioned in wire receiving spaces 14 and 24. Cable 60 is generally cylindrical and has a central axis C. Excess wire is then trimmed from the ends of wires 30 (see FIG. 4A).

Figure 5:
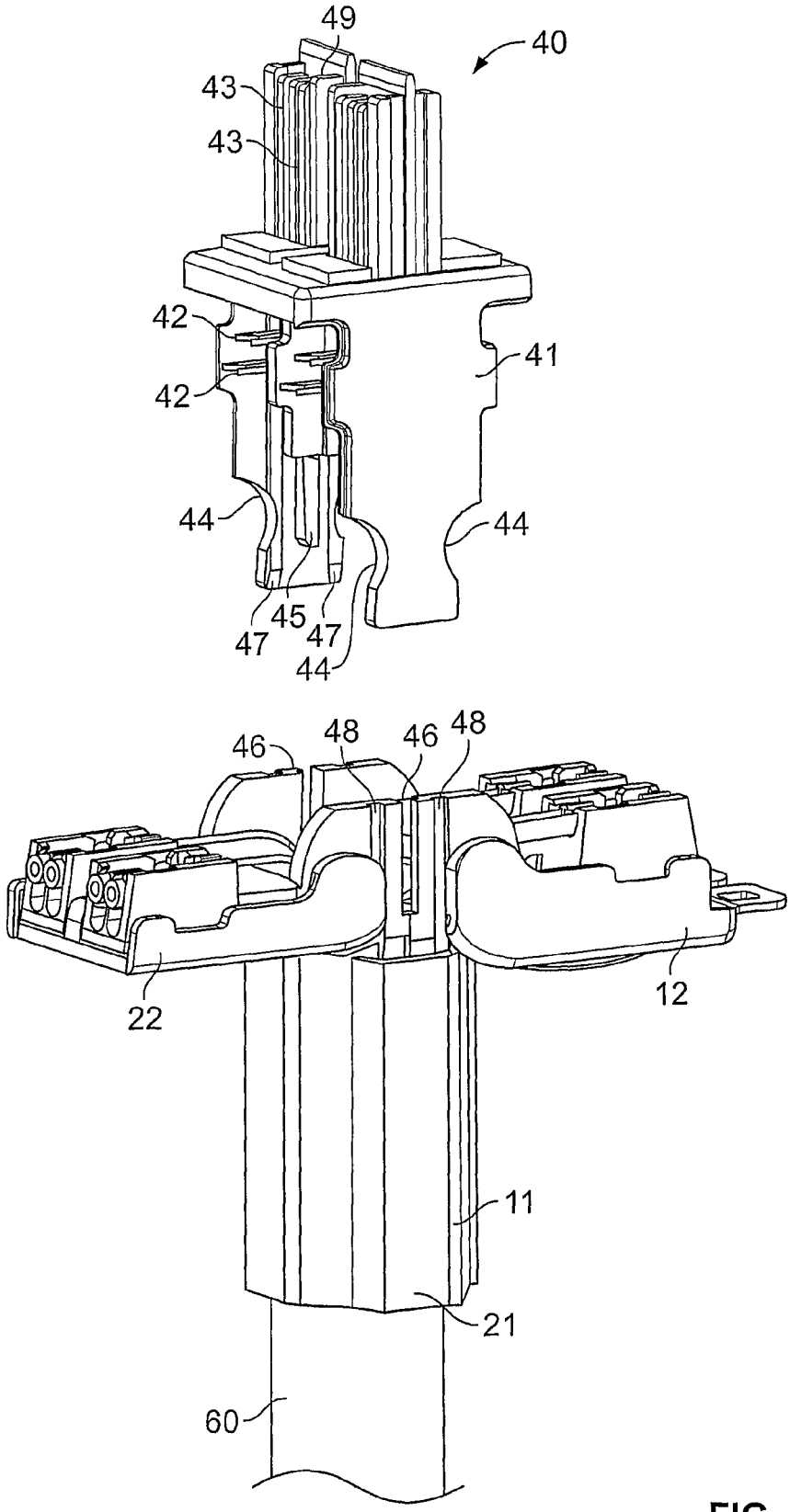
FIGS. 5 & 6 show a thirdsub-assembly being fitted to the assembly of FIG. 4.

Referring to FIG. 5, a third sub-assembly 40 is shown which includes a carrier 41 formed from Zamak. Eight insulation-displacing contacts 42 are mounted in the carrier and are insulated from the carrier by plastic inserts. The insulation-displacing contacts are in electrical connection with plug contacts 43 which are housed in insulating contact holder 49, which may be integral with the aforementioned plastic inserts. Carrier 41 is to be assembled with the first and second sub-assemblies to form a connector. Note that lug 45 will locate in groove 46. Also, four lugs 47 will engage with four grooves 48, which serve both to align sub-assembly 40 with the casings 11, 21 already assembled on the cable, and to resist unintentionally disengagement of the casings 11, 21. Carrier 41 also includes recesses 44 which are used to retain the carrier in the assembled connector as will now be described.

Figure 6:
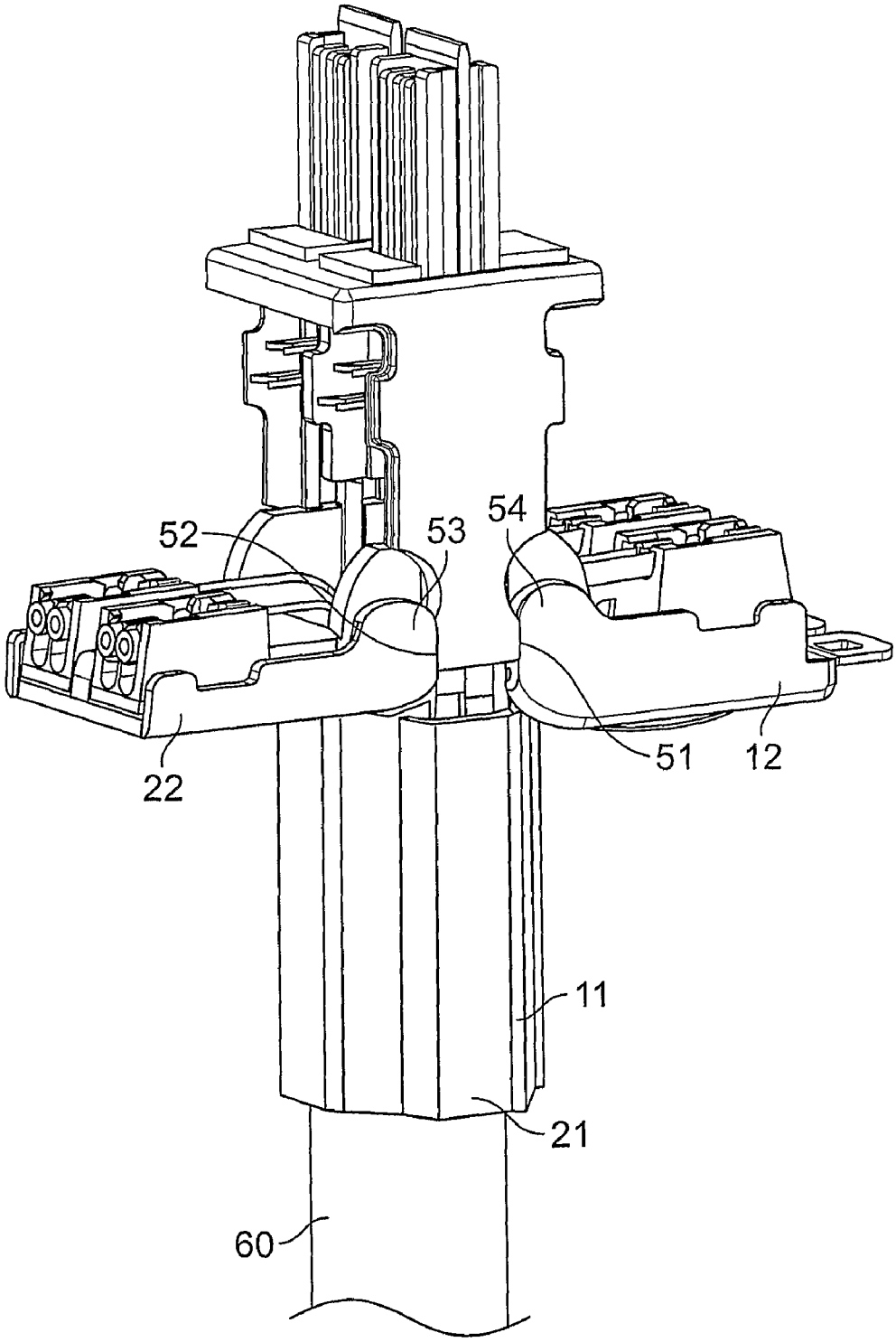

Referring to FIG. 6 the connector is shown partially assembled. Carrier 41 is shown passing by flat portions 51, 52 of covers 22, 12. To ensure right-way-around assembly, the distance between flat portions 51 and 52 and the relevant lug width are different on the opposite sides of carrier 41, so that sub-assembly 40 will be assemblable only in its correct position. After complete insertion of carrier 41, covers 12 and 22 are free to pivot about their respective axes to bring the wires towards the insulation-displacing contacts. As the covers 22, 12 rotate, cam portions 54, 53 of the covers come into engagement with recesses 44 of carrier 41. The covers 22, 12 are moved towards their closed position by hand and are pushed to their closed position by gripping about the entire assembly with pliers and squeezing so that the wires are properly engaged with the insulation-displacing contacts.

Figure 7:
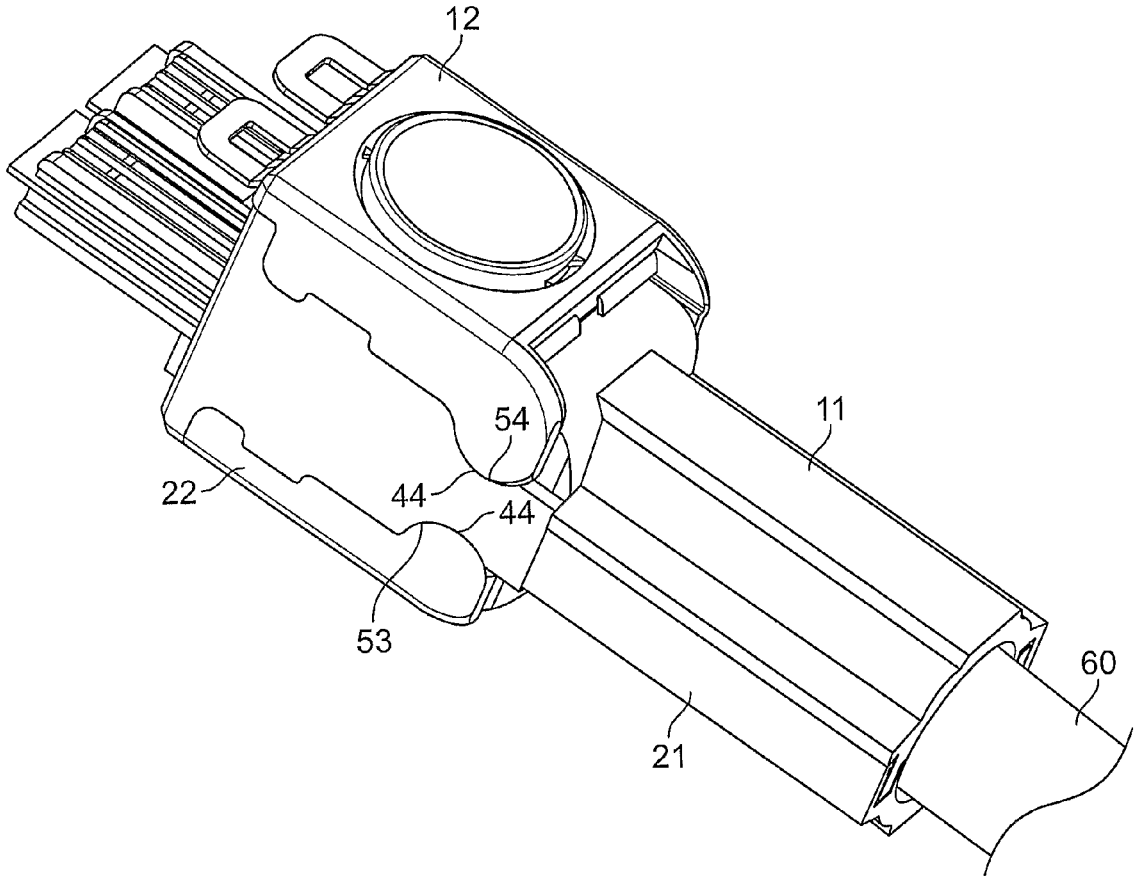
FIG. 7 shows an assembled connector according to the invention.

Referring to FIG. 7, the connector is shown fully assembled. The covers, casings and carrier serve to completely surround the inside of the connector, thus shielding the wires inside the connector from electromagnetic interference.

Figure 8:
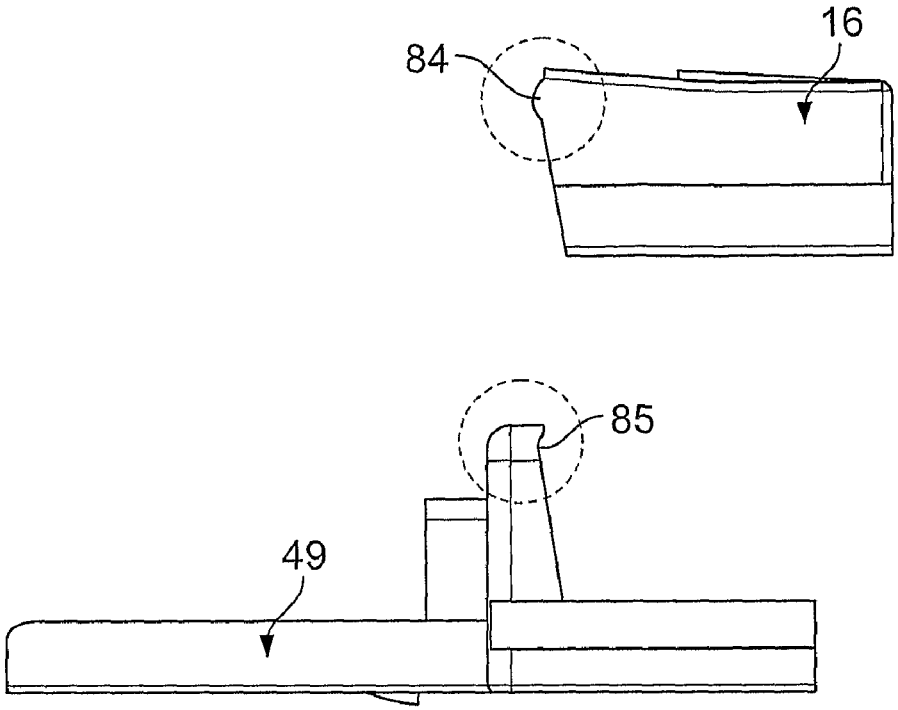
FIGS. 8 & 9 illustrate components of the connector of FIG. 7 in more detail.
Figure 9:
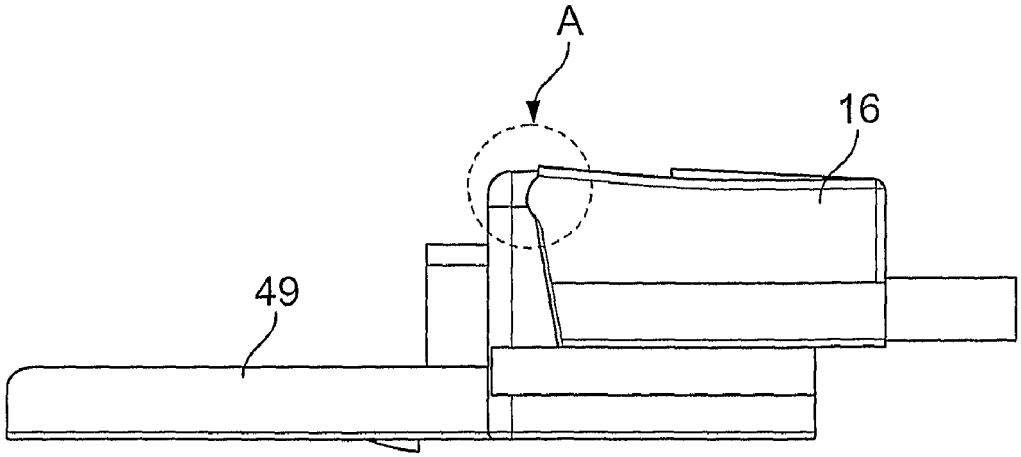
Figure 10:
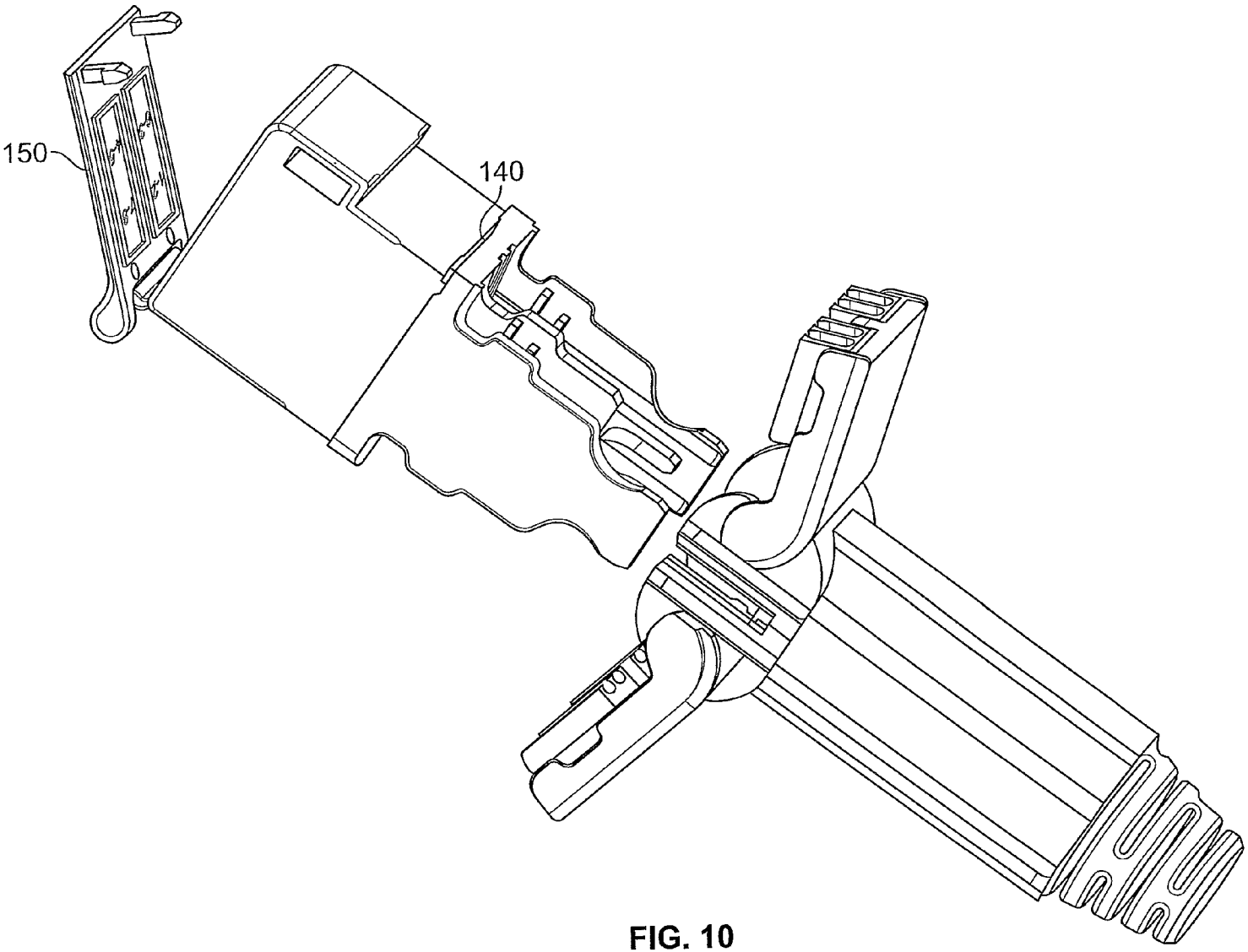
FIG. 10 shows an alternative embodiment of a connector according to the invention partly assembled.
Figure 11:
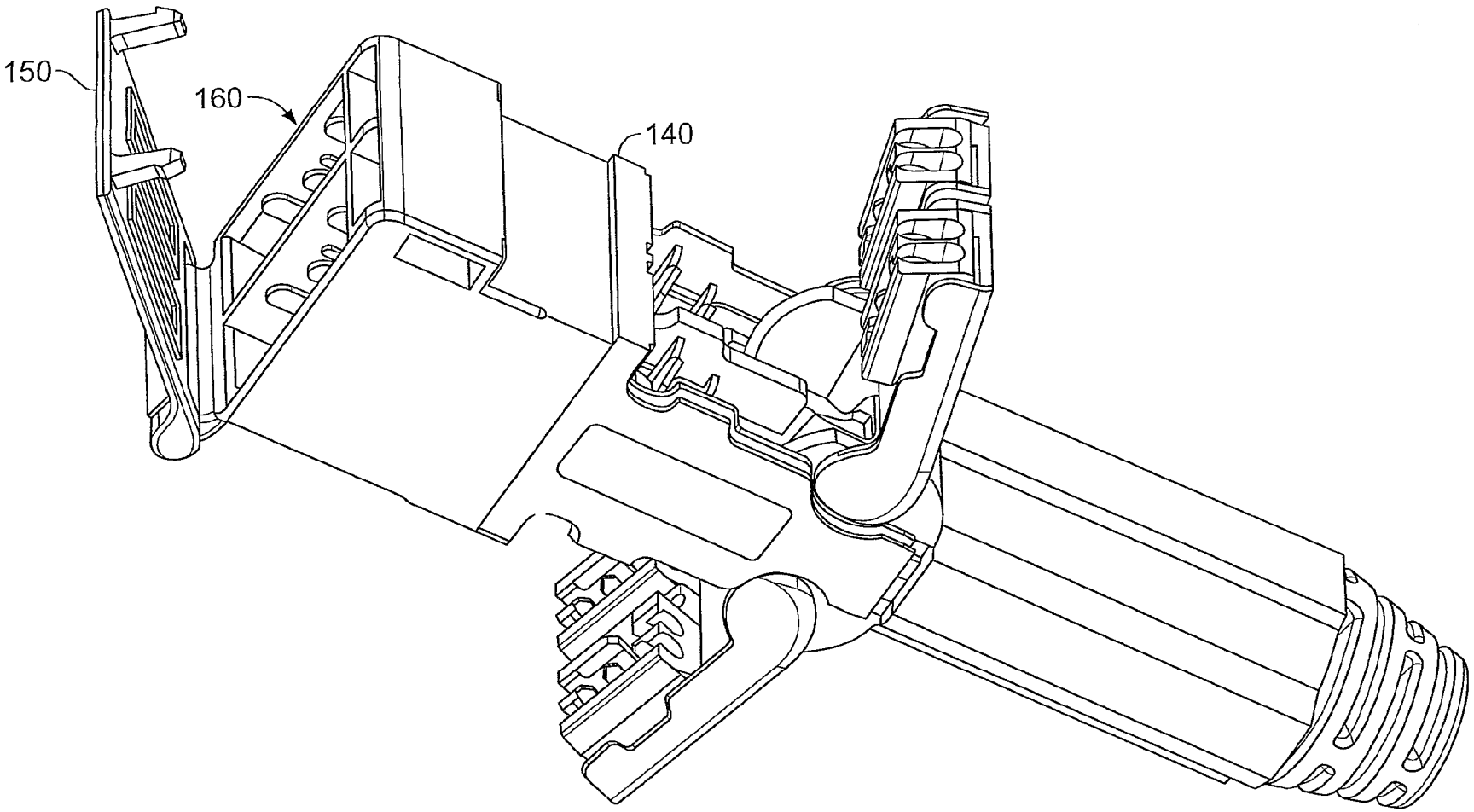
FIGS. 11 and 12 show the connector of FIG. 10 being further assembled.
Figure 12:
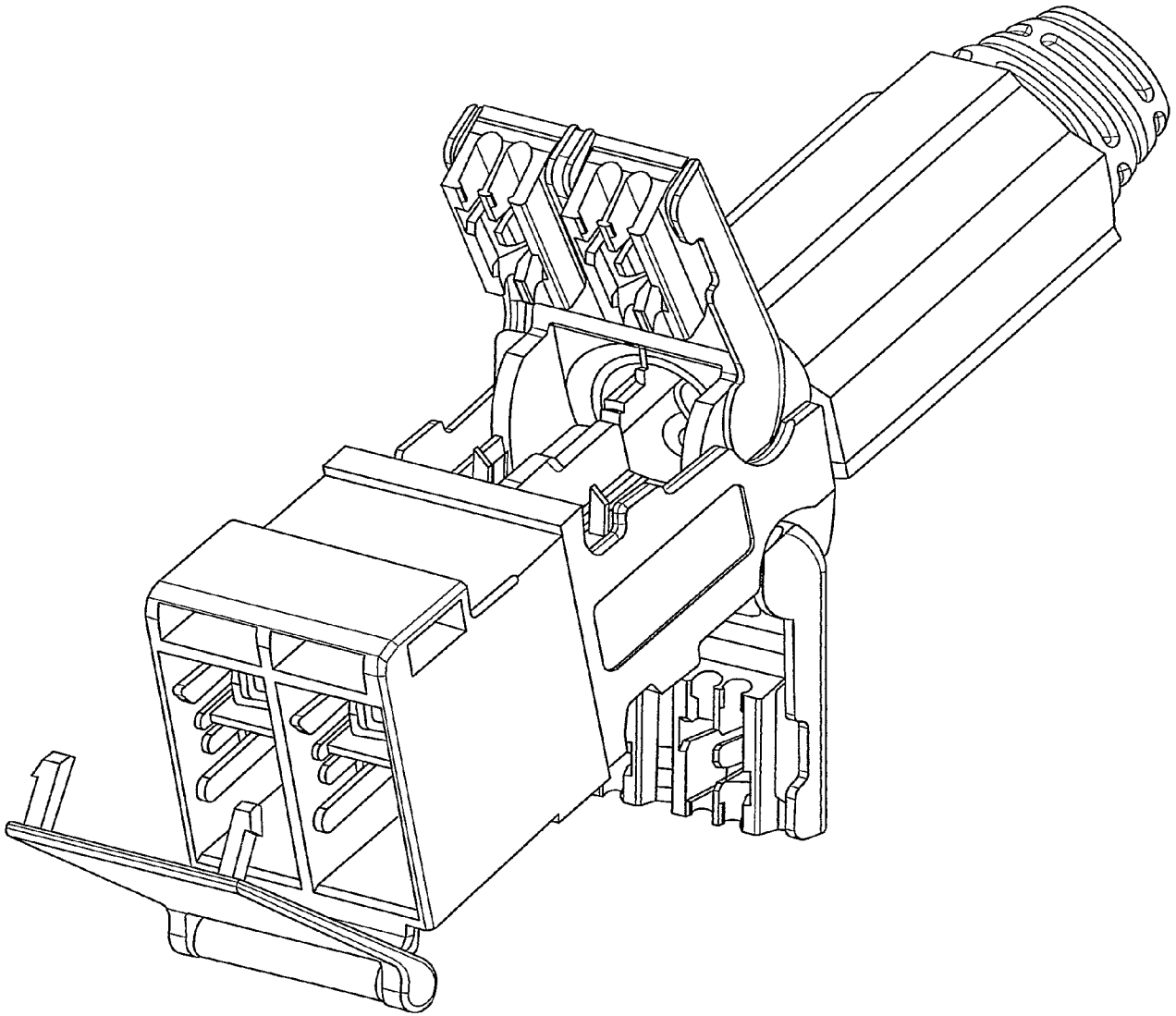
Figure 13:
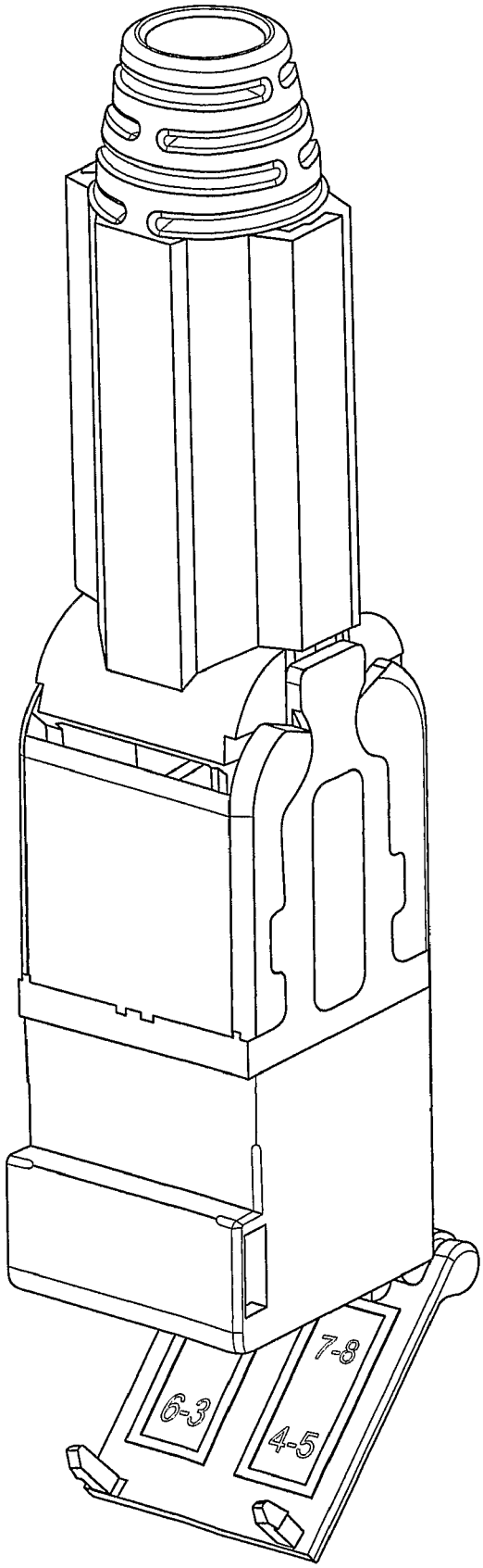
FIGS. 13 and 14 show the connector of FIG. 10 fully assembled.
Figure 14:
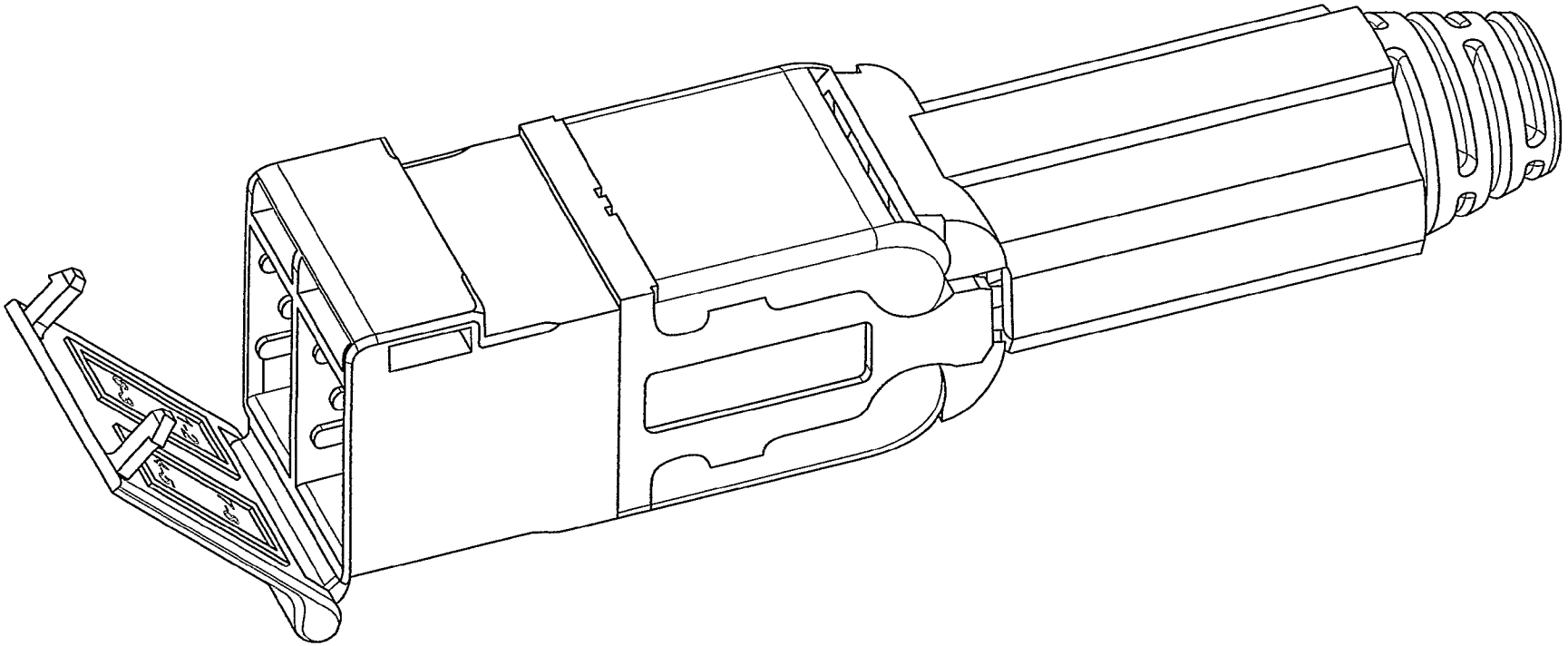

Referring to FIGS. 8 and 9, lacing fixture 16 and contact holder 49 are shown. When the covers of the connector are closed, the lip 84 of lacing fixture 16 snaps into the recess 85 on the contact holder, thus helping to keep the covers in the closed position.

FIGS. 10 to 14 show a female or jack type connector, which is similar in construction to the male or plug type connector shown in FIGS. 5 to 7, and is intended to mate with the plug type connector. The main difference of the jack connector from the plug connector is found in the contact carrier 140. It can be seen that contact carrier 140 provides a female type connection in the form of a recess generally indicated by arrow 160 which accommodates the male type connector previously described. Recess 160 may be protected by dust cover 150.

Figure 15:
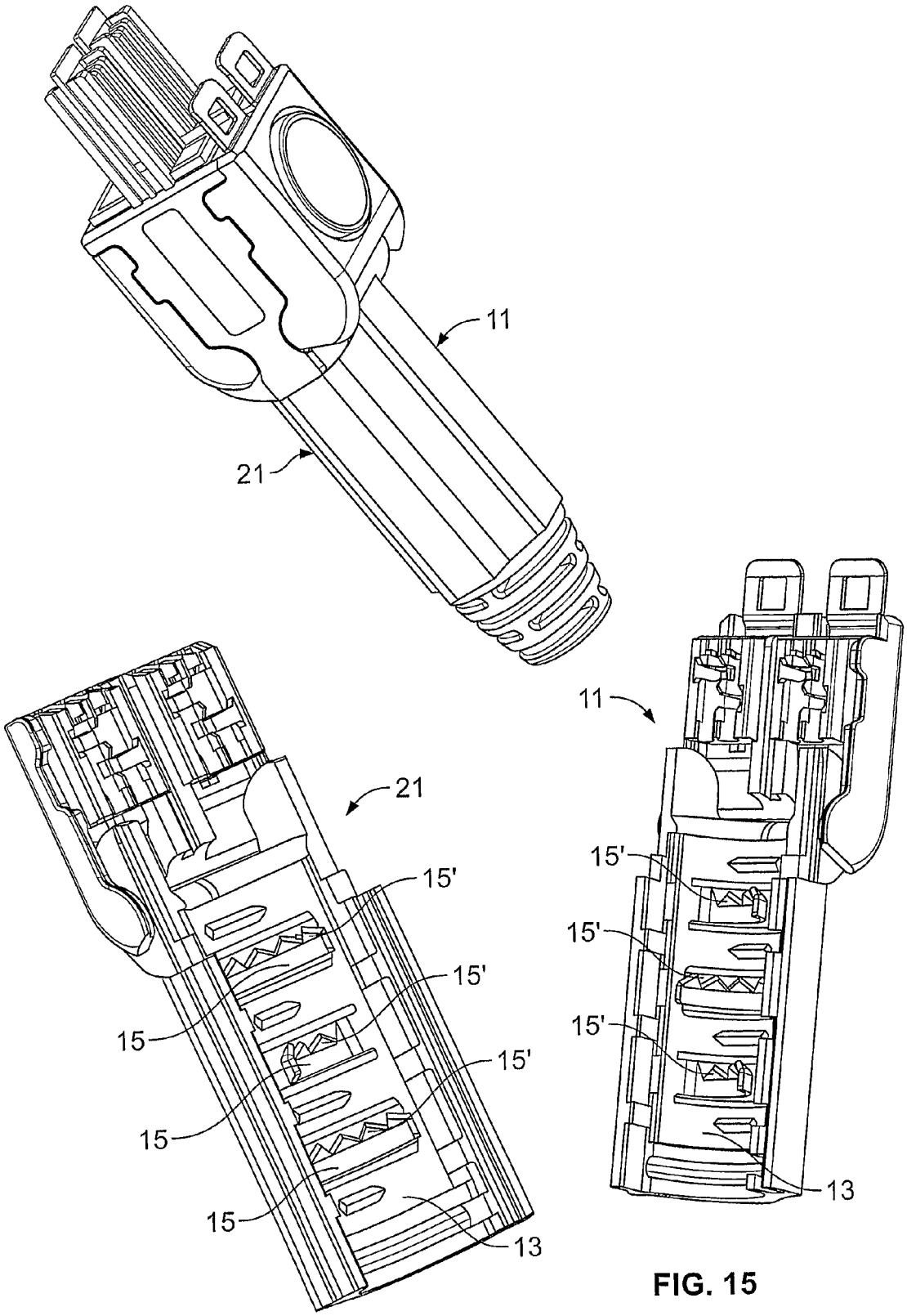
FIG. 15 shows the preferred toothed spring flanges of the cable-enclosing half-shell sub-assemblies.

FIG. 15 illustrates the aforementioned preferred toothed spring flanges 15 in the upper and lower cable-gripping sub-assemblies 11, 21.

Figure 16:
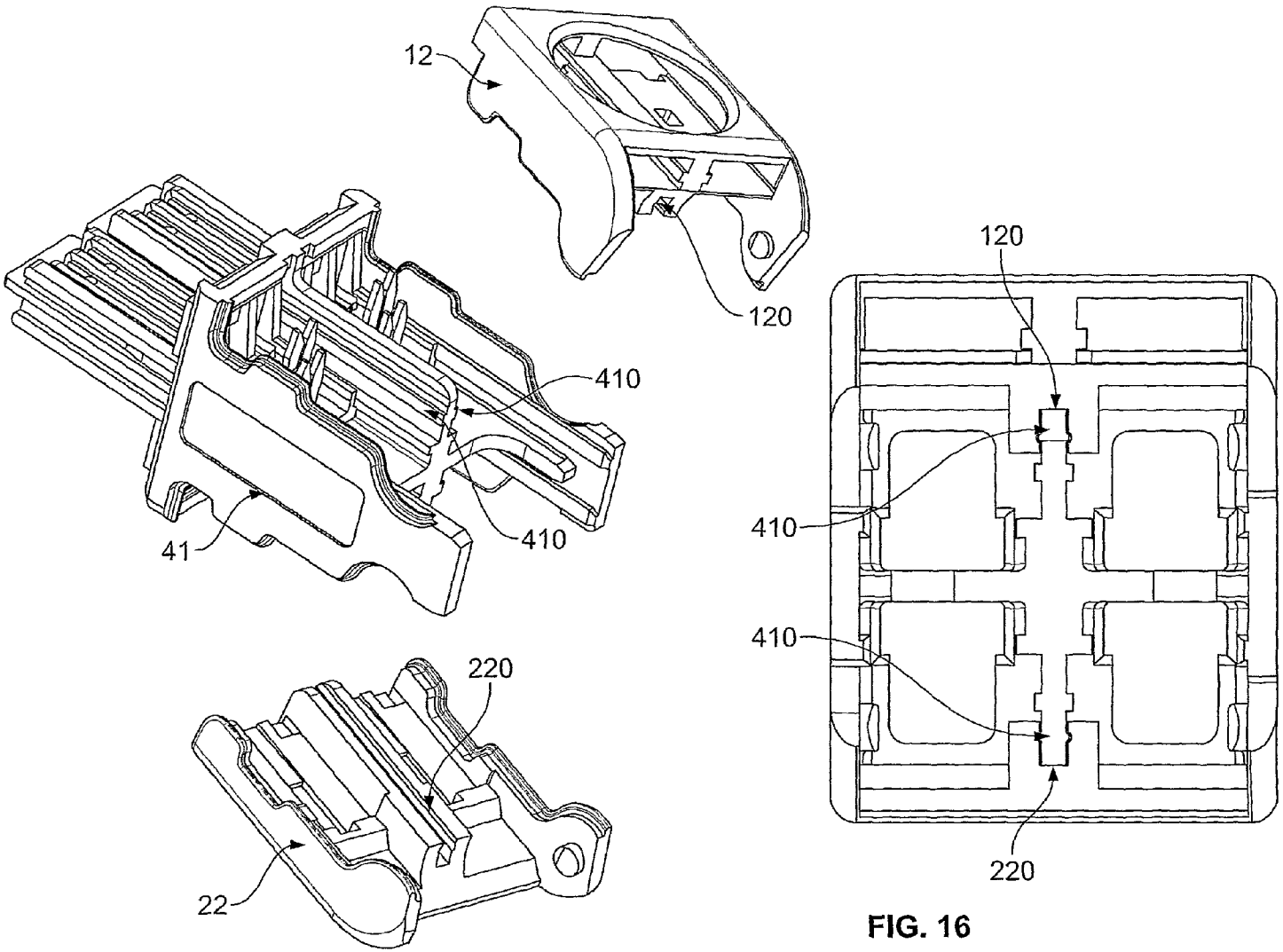
FIG. 16 shows the preferred snap-fit slot and rib formations for securing the hinged covers in the closed position on the contact carrier.

FIG. 16 illustrates the addition of ribs 410 in the carrier 41 and slots 120, 220 in the hinged covers 12, 22, which ribs snap-fit into the slots to hold the covers 12, 22 releasably in the closed position around the contact carrier 41.

In the above described embodiments, the end of the finished connector which bears the plug contacts extends away from the cable substantially in line with the axis of the cable. However, alternative constructions where the plug contacts extend at an angle to the axis of the cable may be employed.

In the embodiments described above, the electrically shielding parts are formed from Zamak, but other metals or electrically conductive materials could be used. A mould-over process may be used to form these components from a metal sheet surrounded by a moulded plastics material. Parts made of plastics in the embodiments described above could alternatively be made of other dielectric materials. In the embodiments described above, connectors with eight sets of contacts are described, but other numbers of contacts could be used, even odd numbers, and the insulation-displacing contacts described could be replaced by other types of contacts as previously mentioned. The cable may include a foil shield or a braided shield, or both foil and braided shields could be present.

In the embodiments described above the cable-surrounding casings were of identical ("mirror image") construction. Alternatively, casings of dissimilar construction could be used, provided that they are dimensioned to mate together in an appropriate manner. The casings may be provided as separate components, or could be provided as a hinged component including two half shells joined along one side of their length.

Finally, it is to be appreciated that various alterations or additions may be made to the parts previously described without departing from the spirit or ambit of the present invention. The present invention includes connectors having the convenient pivoting structure of the present invention wherein some or all of the shielding parts described above may be replaced by plastics parts or other electrically insulating parts when less-shielded or unshielded connectors are required.

The invention claimed is:

1. A connector assembly for use in terminating communications cables including electrical contacts arranged in a contact carrier and profiled to receive wires of a communications cable, and at least one casing being profiled to engage an outer jacket of the communications cable, and at least one cover pivotally coupled to the casing and having wire-receiving spaces for guiding the wires, wherein the cover is arranged to move pivotally to bring wires received in the said spaces into lateral engagement with the electrical contacts.

2. A connector according to claim 1, wherein the at least one cover is pivotally moveable from a first position to a second position, the cable terminated by the connector has a longitudinal axis and in the first position the wire receiving spaces extend away from the longitudinal axis of the cable and in moving to the second position the wire receiving spaces are brought closer to aligning with the axis.

3. A connector according to claim 1, wherein the electrical contacts are insulation-displacing contacts.

4. A connector according to claim 1, which includes snap-fit formations on the at least one casing and the contact carrier, which formations snap-fit together to hold the cover releasably in the said second position.

5. A connector according to claim 1, having on opposite sides of the connector two outward-facing sets of the contacts and two said covers respectively associated with the two sets of contacts.

6. A connector according to claim 5, wherein the two sets of contacts and their respective covers are substantially identical.

7. A connector according to claim 1, profiled as either a plug or a jack.

8. A connector according to claim 1, wherein the connector includes two casings in the form of shells which fit about the cable.

9. A connector according to claim 8, wherein the shells further include resilient flanges which flanges press against the cable to grip the cable, and which flanges have teeth that penetrate through and make electrical contact with a foil, braid, or other shield of the cable.

10. A connector according to claim 9, wherein the resilient flanges are provided on a removable insert of the shell.

11. A connector according to claim 8, wherein the shells snap-fit together.

12. A connector according to claim 11, wherein the snap-fit is achieved by way of a lug which extends along substantially the entire length of at least one of the shells.

13. A connector according to claim 1, wherein the electrical contacts are provided on a removable contact carrier.

14. A connector according to claim 13, wherein the electrical contacts are provided on opposed faces of the carrier.

15. A connector according to claim 13, wherein the carrier is retained in the connector by the at least one cover.

16. A connector according to claim 13, wherein the carrier shields the inside of the connector at least partly from external electromagnetic radiation and at least partly prevents or reduces emission of electromagnetic radiation from the connector and/or cross-talk between wires within the connector.

17. A connector according to claim 13, wherein the carrier includes at least one recess that aligns with the at least one cover to position the carrier in the connector.

18. A connector according to claim 17, wherein the recess receives a cam portion of the at least one cover to position the carrier.

19. A connector according to claim 1, wherein the at least one cover shields the inside of the connector at least partly from external electromagnetic radiation and at least partly prevents or reduces emission of electromagnetic radiation from the connector.

20. A cable clamp for a connector, the cable clamp including at least two shells which fit about a cable, wherein the shells further include resilient flanges which press against the cable to grip the cable and at least one cover pivotally associated with one of the shells and having wire-receiving spaces for guiding wires of the cable.

21. A cable clamp according to claim 20, wherein the resilient flanges are provided on a removable insert of the shell.

22. A cable clamp according to claim 20, wherein the resilient flanges include teeth that penetrate through and make electrical contact with a foil, braid, or other electromagnetic shielding carried by the cable.

23. A cable clamp according to claim 20, wherein the at least two shells snap-fit together about the cable.

24. A cable clamp according to claim 23, wherein the snap-fit is achieved by way of a lug which runs for substantially the entire length of at least one of the shells.

25. A communications connector comprised of a contact carrier and at least one casing, the carrier including electrical contacts provided on a body portion of the carrier for inter-engagement with wires of a communications cable, wherein the casing includes at least one pivotable cover having wire-receiving spaces for receiving the wires, and a projection, and the carrier includes at least one recess that may be engaged with the projection of the casing to retain the carrier in the connector when the carrier is correctly inserted in the casing and the pivotable cover is pivoted to a closed position aligning the wires with the electrical contacts.

26. A contact carrier according to claim 25, which shields wires inside the connector at least partly from external electromagnetic radiation and at least partly prevents or reduces emission of electromagnetic radiation from the connector and/or cross-talk between wires within the connector.

27. A contact carrier according to claim 25, wherein the electrical contacts are provided on opposed faces of the carrier.

28. A connector for use in terminating communications cables including electrical contacts arranged on a removable contact carrier to receive wires of a communications cable, and at least one cover pivotally associated with the connector and having wire-receiving spaces for guiding the wires, the cover being arranged to move pivotally to bring wires received in the said spaces into lateral engagement with the electrical contacts, wherein the carrier includes at least one recess that aligns with the at least one cover to position the carrier in the connector, and wherein the recess receives a cam portion of the at least one cover to position the carrier.

* * * * *